US011619062B2

(12) United States Patent
Abrams et al.

(10) Patent No.: US 11,619,062 B2
(45) Date of Patent: Apr. 4, 2023

(54) UTILITY STRUCTURE WITH RETRACTABLE MAST

(71) Applicant: DUKE ENERGY CORPORATION, Charlotte, NC (US)

(72) Inventors: Ted A. Abrams, Fuquay-Varina, NC (US); Peter N. Henderson, Raleigh, NC (US); Max G. Hazelrigg, Boulder, CO (US)

(73) Assignee: Duke Energy Corporation, Charlotte, NC (US)

( * ) Notice: Subject to any disclaimer, the term of this patent is extended or adjusted under 35 U.S.C. 154(b) by 31 days.

(21) Appl. No.: 17/173,929

(22) Filed: Feb. 11, 2021

(65) Prior Publication Data

US 2021/0246682 A1 Aug. 12, 2021

Related U.S. Application Data

(60) Provisional application No. 62/975,370, filed on Feb. 12, 2020.

(51) Int. Cl.

| | |
|---|---|
| ***E04H 12/18*** | (2006.01) |
| ***E04H 12/08*** | (2006.01) |
| ***E04H 12/34*** | (2006.01) |
| *H01Q 1/12* | (2006.01) |

(52) U.S. Cl.

CPC ..... *E04H 12/18* (2013.01); *E04H 12/08* (2013.01); *E04H 12/34* (2013.01); *H01Q 1/1235* (2013.01); *H01Q 1/1242* (2013.01)

(58) Field of Classification Search

CPC ..... E04H 12/18; E04H 12/08; E04H 12/34; H01Q 1/1235; H01Q 1/1242; H01Q 1/246

See application file for complete search history.

(56) References Cited

U.S. PATENT DOCUMENTS

| | | | | | |
|---|---|---|---|---|---|
| 3,713,195 | A | * | 1/1973 | Togiya | E04H 12/28 29/897.33 |
| 4,027,441 | A | * | 6/1977 | Pitelyaev | E04H 12/34 173/28 |
| 4,185,288 | A | * | 1/1980 | Dosch | H01Q 3/08 343/765 |
| 4,231,200 | A | * | 11/1980 | Henderson | E04H 12/34 182/19 |
| 4,696,135 | A | * | 9/1987 | Kallinger | E04H 12/34 249/20 |

(Continued)

*Primary Examiner* — Phi D A

(74) *Attorney, Agent, or Firm* — Myers Bigel, P.A.

(57) ABSTRACT

A tower configured to be positioned adjacent to or as a part of existing electrical power utility structures, such as transmission towers, distribution towers, substation structures, etc., includes an outer structure having a lower end configured to be anchored to the ground, and an opposite upper end. An inner structure is positioned within the outer structure and is connected to the outer structure. The inner structure has a lower end configured to be anchored to the ground and an opposite upper end. A mast is movable within the inner structure between a lowered position and a raised position. The mast supports various electronic equipment, such as cellular antenna arrays, remote radio unit (RRU) arrays, microwave antennas, imaging equipment, acoustic sensors, tectonic or motion sensors, thermal sensors, chemical sensors, and/or nuclear sensors.

19 Claims, 19 Drawing Sheets

(56) References Cited

U.S. PATENT DOCUMENTS

| | | | | |
|---|---|---|---|---|
| 4,932,176 | A * | 6/1990 | Roberts | H01Q 1/1235 52/118 |
| 5,025,606 | A * | 6/1991 | McGinnis | E04H 12/20 52/149 |
| 5,995,063 | A * | 11/1999 | Somoza | H01Q 1/12 343/890 |
| 6,353,419 | B1 * | 3/2002 | Gates | H01Q 3/08 343/882 |
| 2005/0093766 | A1 * | 5/2005 | Turner | H01Q 1/1235 343/900 |
| 2014/0318040 | A1 * | 10/2014 | Edwards | E04H 12/34 52/118 |
| 2015/0050070 | A1 * | 2/2015 | Dykes | H01Q 1/1235 403/109.2 |
| 2016/0130832 | A1 * | 5/2016 | Zavitz | F03D 13/10 52/745.17 |
| 2016/0261019 | A1 * | 9/2016 | Garmong | E04H 12/187 |
| 2018/0179777 | A1 * | 6/2018 | Tuerk | F03D 13/20 |
| 2020/0227810 | A1 * | 7/2020 | Taylor | H01Q 1/08 |
| 2021/0207393 | A1 * | 7/2021 | Konduc | B66C 23/207 |

* cited by examiner

UTILITY STRUCTURE WITH RETRACTABLE MAST

RELATED APPLICATION

This application claims the benefit of and priority to U.S. Provisional Patent Application No. 62/975,370 filed Feb. 12, 2020, the disclosure of which is incorporated herein by reference as if set forth in its entirety.

FIELD OF THE INVENTION

The present invention relates generally to towers and, more particularly, to utility structures and telecommunications towers.

BACKGROUND OF THE INVENTION

Cellular communications towers are typically provided in urban and densely populated areas. However, tower siting is becoming increasingly more difficult for telecommunications service providers due to public opposition to erecting large towers in public spaces. As such, being able to leverage existing electric utility transmission structures is an attractive option. However, due to operational and construction issues associated with attaching cellular radios and antennas to electrical infrastructure, collocation of this equipment on electrical power transmission towers is the attachment of last resort for many telecommunications service providers. One reason is the need for electrical line safety clearance for installation and maintenance of the telecommunications equipment. Another reason is that existing electrical power transmission structures may not be structurally capable of supporting such additional loads. As such, collocation of cellular radios and antennas or other network devices on existing electrical power transmission towers may require structural modification, which can be costly.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

Embodiments of the present invention provide towers that are configured to be positioned adjacent to or as a part of existing electrical power utility structures, such as transmission towers, distribution towers, substation structures, etc. According to some embodiments of the present invention, a tower includes an outer structure having a lower end configured to be anchored to the ground and an opposite upper end. An inner structure is positioned within the outer structure and is structurally connected to the outer structure. The inner structure has a lower end configured to be anchored to the ground and an opposite upper end. A mast is movable within the inner structure between a lowered position and a raised position, and is configured to support various electronic equipment. At least a portion of the mast extends through the upper end of the inner structure and the upper end of the outer structure when the mast is in the raised position.

The mast is configured to support various equipment, such as cellular antenna arrays, remote radio unit (RRU) arrays, microwave antennas, imaging equipment, and sensors to detect various anomalies, such as chemical anomalies, biological anomalies, radiological anomalies, nuclear anomalies, thermal anomalies, tectonic anomalies, acoustic anomalies, etc. For example, the Department of Homeland Security, law enforcement, and other organizations may utilize embodiments of the present invention for positioning various types of CBRN (chemical, biological, radiological, nuclear) defense sensors. Acoustic sensors may be utilized to detect gunshots. Tectonic or motion sensors may be utilized to detect the presence of vehicles in the area (e.g., in the right-of-way where a cell tower and transmission tower are located) and to detect climbers on the cell tower and/or adjacent transmission tower. Thermal sensors may be utilized to detect fire. Imaging equipment may be video or still, visible or infrared. The various equipment supported on the mast may be electronic or optical, either fiber optic or free-space optic.

The inner structure includes a plurality of spaced, parallel guide rails. Each guide rail has opposite upper and lower end portions and includes an upper latch movably secured to the guide rail upper portion and a lower latch movably secured to the guide rail lower portion. The upper latch and the lower latch are movable between open and closed positions via an actuator, and typically in tandem for each guide rail. The upper latch of each guide rail is configured to support the mast when the mast is in the raised position. Each guide rail also includes a mast support saddle on the lower portion thereof that supports the mast when the mast is in the lowered position. Each guide rail also includes a docking clamp movably secured to an upper portion of the guide rail. Each docking clamp is configured to restrain the mast when the mast in in the raised position.

The mast includes a plurality of docking arms that extend outwardly therefrom. Each docking arm is movably connected to a respective guide rail and is movable along the guide rail as the mast is moved between the lowered position and the raised position. Each guide rail docking clamp is configured to move and engage a respective docking arm when the mast in in the raised position. In some embodiments, each docking arm is movable along a respective guide arm via a trolley assembly that is in rolling engagement with a respective guide rail. In some embodiments, each guide rail is an I-beam (e.g., a wide flange), and each trolley assembly includes two pairs of wheels, wherein the wheels of each pair straddle opposing sides of the I-beam.

The mast also includes a plurality of guide arms that extend outwardly therefrom. Each guide arm is movably connected to a respective guide rail and is movable along the guide rail as the mast is moved between the lowered position and the raised position. In some embodiments, each guide arm is movable along a respective guide arm via a trolley assembly that is in rolling engagement with a respective guide rail. In some embodiments, each guide rail is an I-beam and each trolley assembly includes two pairs of wheels, wherein the wheels of each pair straddle opposing sides of the I-beam.

In some embodiments, the mast includes a counterweight that is movably secured to a lower portion thereof. A position of the counterweight relative to the mast is adjustable so as to maintain the mast plumb as the mast is raised and lowered. In some embodiments, the counterweight is movable radially relative to the mast and/or is movable about an axis of the mast.

The mast is raised and lowered via a lifting cable. One end of the lifting cable is secured to the mast and the other end of the lifting cable is operably associated with a winch system which is used to raise and lower the mast. The inner structure of the tower may include one or more sheaves or pulley wheels secured thereto and the lifting cable rides on these pulley wheels during raising and lowering operations. The lifting cable remains in place at all times except in those instances when the lifting cable is removed for inspection and/or replacement. The "captive" lifting cable is an advantageous feature of the present invention. Conventional lifting or hoisting methods make temporary use of cable provided by others, cable that is associated with a crane or service-truck winch. Those conventional methods often require personnel to be at elevated positions in order to attach or disconnect the lifting cable from the equipment, that is to say, for "rigging the load". Embodiments of the present invention do not require personnel to be up on top of the structure, working at heights near electrical conductors, in order to rig the load for lifting, because the lifting cable is attached or disconnected when the load is resting on the maintenance saddles. Conventional methods use a lifting cable to raise and lower equipment or personnel. In contrast, embodiments of the present invention use a captive cable to raise and lower the movable mast complete with assembled equipment. The captive lifting cable and sheaves are not intended to move personnel. Furthermore, the manner of cable attachment, cable routing, and cable storage of the present invention facilitates replacement of the cable without any rigging at height. With the mast in the maintenance position, using a leader-line, the lifting cable can be disconnected from the lifting lug, pulled through the sheaves, inspected and then replaced by using the leader-line to pull the inspected cable through the sheaves into the service position to be re-attached. With the electrical conductors de-energized, with no voltage present, the top sheave assembly is installed during initial construction, and subsequently inspected when the electrical conductors are again de-energized: de-energized because of electrical utility requirements, not because of mast tenant request. By simplicity and design, that top sheave assembly, including the sheave itself, the shaft, bearings, and end plates are inherently reliable with mean time between failure (MTBF) exceeding the interval between de-energized inspection and maintenance of the electrical conductors.

In some embodiments, the outer structure of the tower includes at least one member extending outwardly therefrom that is connected to an external structure, such as an electrical power transmission tower, an electrical power distribution tower, an electrical substation structure, etc. The at least one member includes a breakable element, such as a shear pin. The tower may also be electrically connected to the external structure.

Towers according to embodiments of the present invention are advantageous because they eliminate the need for technicians to climb or work above or near electrical power conductors on adjacent electrical transmission towers. The mast may be lowered such that the various equipment (e.g., cellular radios, antennas, etc.) supported thereon can be easily and safely accessed. Moreover, the mast is configured to allow multiple antenna centers in contrast to many conventional tower designs that only allow one array. In addition to eliminating the need to work above electrical power conductors, embodiments of the present invention also allow greater antenna mounting heights in order to serve more locations of need. Furthermore, towers according to embodiments of the present invention do not add load to adjacent structures to which they are attached. In fact, towers according to embodiments of the present invention can strengthen adjacent structures as a result of being attached thereto.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate various embodiments of the present invention. The drawings and description together serve to fully explain embodiments of the present invention.

DETAILED DESCRIPTION

Figure 1:
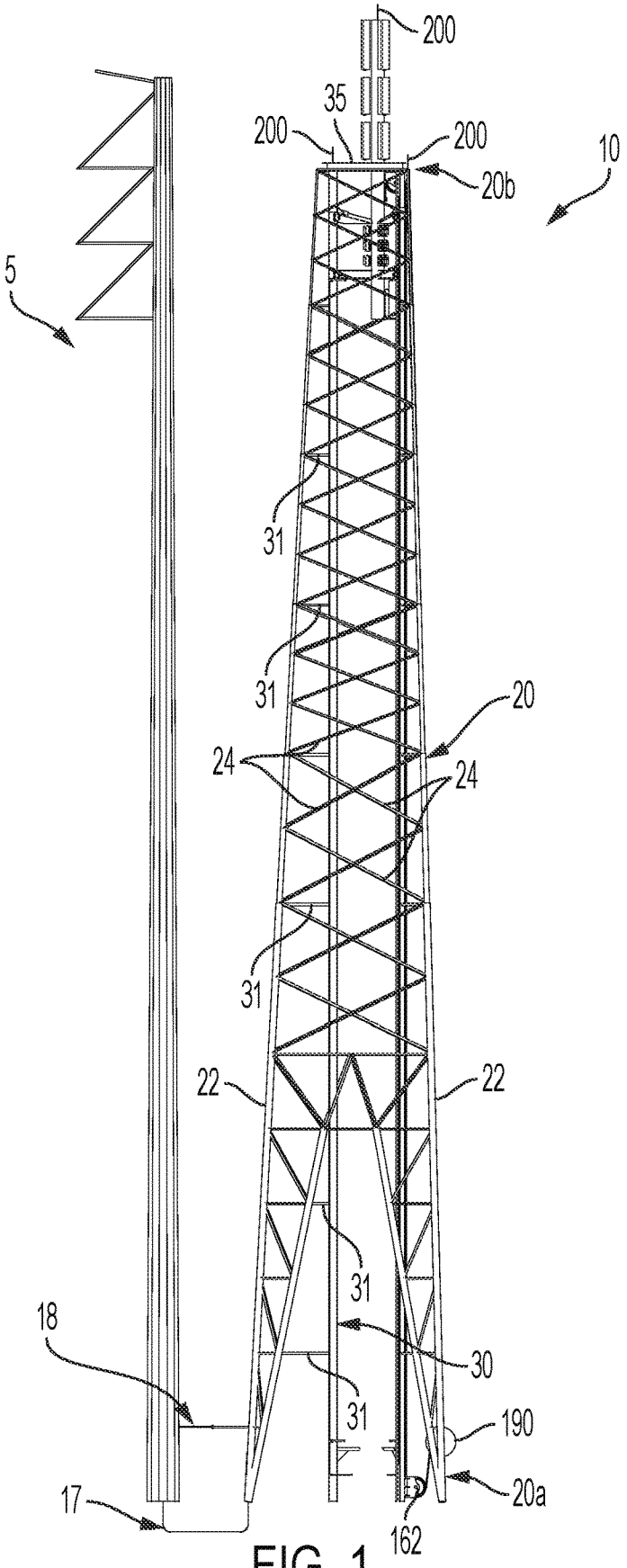
FIG. 1 is a front view of a tower according to some embodiments of the present invention and co-located adjacent an electrical power transmission tower.
Figure 2:
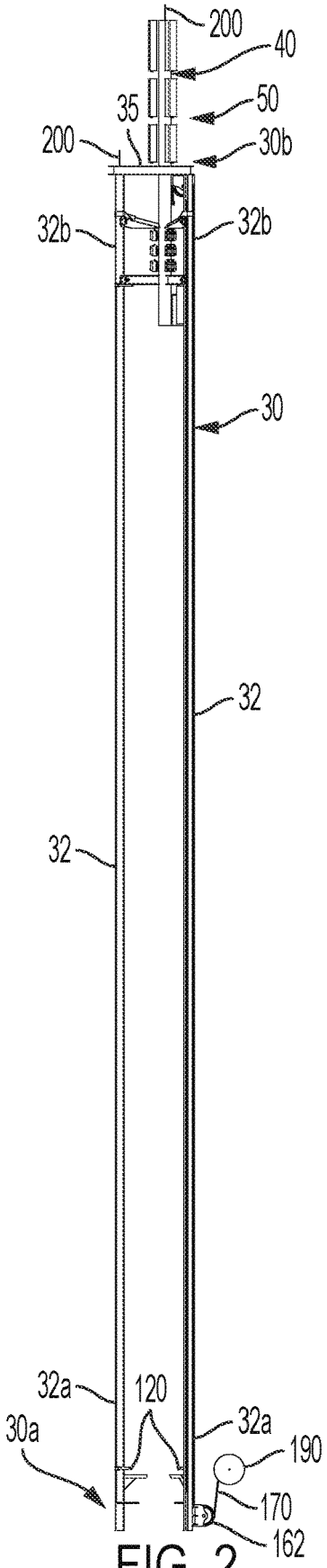
FIG. 2 is a front view of the inner structure of the tower of FIG. 1, with the outer structure removed for clarity, and illustrating the mast in the raised position.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain components or features may be exaggerated for clarity, and broken lines illustrate optional features or operations unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

When an element is referred to as being "connected", "coupled", "responsive", or variants thereof to another element, it can be directly connected, coupled, or responsive to the other element or intervening elements may be present. In contrast, when an element is referred to as being "directly connected", "directly coupled", "directly responsive", or variants thereof to another element, there are no intervening elements present. Like numbers refer to like elements throughout. As used herein, the singular forms "a", "an" and "the" are intended to include the plural forms as well, unless the context clearly indicates otherwise. Well-known functions or constructions may not be described in detail for brevity and/or clarity. The term "and/or" includes any and all combinations of one or more of the associated listed items.

As used herein, the terms "comprise", "comprising", "comprises", "include", "including", "includes", "have", "has", "having", or variants thereof are open-ended, and include one or more stated features, integers, elements, steps, components or functions but does not preclude the presence or addition of one or more other features, integers, elements, steps, components, functions or groups thereof. Furthermore, as used herein, the common abbreviation "e.g.," which derives from the Latin phrase "exempli gratia," may be used to introduce or specify a general example or examples of a previously mentioned item, and is not intended to be limiting of such item. The common abbreviation "i.e.," which derives from the Latin phrase "id est," may be used to specify a particular item from a more general recitation.

It will be understood that although the terms first, second, third, etc., may be used herein to describe various elements/operations, these elements/operations should not be limited by these terms. These terms are only used to distinguish one element/operation from another element/operation. Thus, a first element/operation in some embodiments could be termed a second element/operation in other embodiments without departing from the teachings of present inventive concepts. The same reference numerals or the same reference designators denote the same or similar elements throughout the specification.

The terms "about" and "approximately", as used herein with respect to a value or number, means that the value or number can vary by +/− twenty percent (20%).

Referring now to the figures, a tower 10 according to some embodiments of the present invention, and co-located adjacent an existing structure such as an electrical power transmission tower 5, is illustrated. The tower 10 includes an outer structure 20, an inner structure 30 positioned within the outer structure 20, and a mast 40 that is movable within the inner structure between a lowered position and a raised position, and that is configured to support various electronic equipment.

The outer structure 20 includes a lower end 20*a* configured to be anchored to the ground, and an opposite upper end 20*b*. In the illustrated embodiment, the outer structure 20 is a tapered lattice structure having a triangular cross-section with three legs 22. The three legs 22 of the outer structure 20 are connected to each other through a series of cross-braces 24 to provide structural rigidity. The legs 22 and cross-braces 24 may be formed from metal, such as steel (e.g., galvanized steel) or aluminum, although other materials may be utilized. Each leg 22 may be anchored directly into the ground, or may be anchored to the ground via a respective foundation, such as a concrete pad or other such structure. For example, each leg 22 may have a flange (not shown) that is bolted or otherwise secured to a respective foundation, as would be understood by one skilled in the art of the present invention. Although illustrated as having a tapered configuration with a triangular cross-section, the outer structure 20 may have various other configurations and shapes. For example, the outer structure 20 may have a rectangular or other polygonal cross-section. Because the functions of lifting the mast 40 and maintaining vertical support of the mast 40 are provided by the inner structure 30, as described below, the outer structure 20 serves primarily as an "exoskeleton" that provides lateral support for the inner structure 30.

In the illustrated embodiment, the inner structure 30 has a lower end 30*a* configured to be anchored to the ground and an opposite upper end 30*b*, and includes three spaced, parallel guide rails 32. Each guide rail 32 may be anchored directly into the ground, or may be anchored to the ground via a respective foundation, such as a concrete pad or other such structure. For example, each guide rail 32 may have a flange (not shown) that is bolted or otherwise secured to a respective foundation, as would be understood by one skilled in the art of the present invention.

In the illustrated embodiment, the inner structure 30 has three equally spaced apart guide rails 32 and the cross section of the inner structure 30 is in the shape of an equilateral triangle. However, the present invention is not limited to the illustrated configuration of the inner structure 30. The inner structure 30 may be formed from various numbers of guide rails 32 and may have various cross-sectional shapes.

In the illustrated embodiment, each guide rail 32 is a wide flange steel beam, also referred to as an "I-beam", having a web 33 and substantially parallel opposite flanges 34 attached to the web 33 (see FIG. 5D), as would be understood by one of skill in the art. The guide rails 32 may have various sizes depending on the size of the tower 10 and the type and quantity of equipment to be supported by the mast 40. In an exemplary embodiment, each guide rail 32 may be fourteen inch (14") wide flange; however, other sizes may be utilized. Each guide rail 32 is structurally connected to the outer structure 20 via one or more members 31, as illustrated in FIG. 1. In addition, in the illustrated embodiment, the guide members 32 are connected together at their upper end portions 32*b* via structural members 35, which may also be wide flange steel beams.

The inner structure 30 is configured to be a robust, self-supporting structure, and is fully sufficient for vertical and axial loads, both static and dynamic. For economy of construction, the composite strength of the inner structure 30 in combination with the outer structure 20 creates a unified structure that meets or exceeds the following standards: NESC-2017 separation from conductors and bonding; IEEE-142-1991 resistance to remote earth; ACI-318-02 foundation design; AISC-LRFD-99 strength and safety factors; ASCE-7-02 structural integrity for critical infrastructure; ANSI-222(G) or current applicable standard, Class III; Geotech safety factor 2.0; Seismic force amplification factor 3.0; and Topographic Category 4.0 (wind speed-up in all directions).

Figure 6:
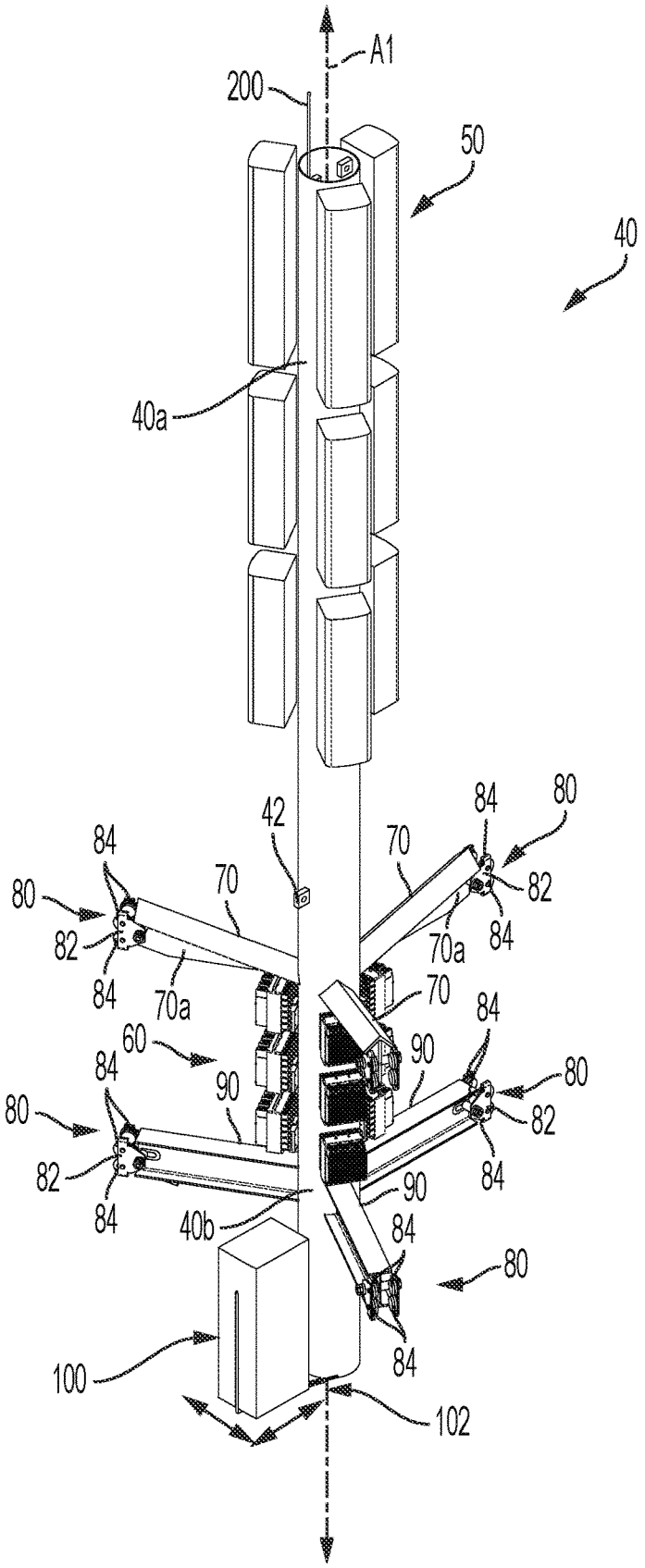
FIG. 6 is a perspective view of the mast of the tower of FIG. 1.

The mast 40 is configured to support various electronic equipment, such as cellular radios and antennas. In some embodiments, the mast 40 is a twenty inch (20") diameter schedule 40 steel pipe, although other pipe sizes and materials may be utilized. In the illustrated embodiment, the mast 40 is supporting cellular antenna arrays 50 and remote radio unit (RRU) arrays 60 (FIG. 6). However, various other equipment can be supported by the mast 40, such as microwave antennas, imaging equipment, and sensors to detect various anomalies, such as chemical anomalies, biological anomalies, radiological anomalies, nuclear anomalies, thermal anomalies, tectonic anomalies, acoustic anomalies, etc. For example, the mast 40 may support acoustic sensors for detecting gunshots, tectonic or motion sensors for detecting vehicles in the area (e.g., in the right-of-way where a cell tower and transmission tower are located) and for detecting climbers on the cell tower and/or adjacent transmission tower, and/or thermal sensors for detecting fire in the area. Imaging equipment may be video or still, visible or infrared imaging equipment.

In the illustrated embodiment, the mast 40 has an upper portion 40*a* (FIG. 6) supporting the cellular antenna arrays 50 and a lower portion 40*b* supporting the RRU arrays 60. In the illustrated embodiment, the mast 40 is sized to support three full tri-sector macro antenna arrays 50 at the upper portion 40*a*, and three full tri-sector RRU arrays 60 at the lower portion 40*b*. As illustrated in FIG. 1, a portion of the mast 40 extends through the upper ends 20*b*, 30*b* of the outer and inner structures 20, 30 of the tower 10 when the mast 40 is in the raised position. This allows the cellular antenna arrays 50 to extend above the tower 10 and to also extend above the electrical power lines supported by the adjacent transmission tower 5.

The mast 40 includes a plurality of docking arms 70 that extend outwardly therefrom in circumferentially spaced-apart relationship (e.g., spaced equally at 120° azimuthal orientation), as illustrated in FIG. 6. The docking arms 70 may be secured to the mast 40 via welding or mechanical fasteners, or via a combination of welding and mechanical fasteners. Each docking arm 70 is configured to be movably connected to a respective guide rail 32 and is movable along the guide rail 32 as the mast 40 is moved between lowered and raised positions. Each docking arm 70 may be a steel angle bar or a steel wide flange beam, although other shapes and materials may be utilized. In the illustrated embodiment, each docking arm 70 has a distal free end 70*a* and a trolley assembly 80 secured to the distal free end 70*a*. Each trolley assembly 80 includes a pair of spaced apart arms 82 that are attached to a docking arm 70. A pair of wheels 84 are supported for rotation on an inward side of each arm 82. Each pair of wheels 84 is configured to engage and roll along an inner flange surface 34*a* (FIG. 7A) on a respective side of a guide rail 32. The illustrated trolley assembly 80 of each docking arm 70 is configured such that the wheels 84 of each pair straddle opposing sides of the guide rail 32. However, embodiments of the present invention are not limited to the configuration of the illustrated trolley assembly 80. Various types of trolley assemblies may be utilized with the docking arms 70, including various numbers and configurations of wheels.

The mast 40 also includes a plurality of guide arms 90 that extend outward therefrom in circumferentially spaced-apart relationship (e.g., spaced equally at 120° azimuthal orientation), as illustrated in FIG. 6. The guide arms 90 may be secured to the mast 40 via welding or mechanical fasteners, or via a combination of welding and mechanical fasteners. The guide arms 90 are positioned below the docking arms 70, as illustrated. Each guide arm 90 is configured to be movably connected to a respective guide rail 32 and is movable along the guide rail 32 as the mast 40 is moved between lowered and raised positions. Each guide arm 90 may be a steel wide flange beam, although other shapes and materials may be utilized. In the illustrated embodiment, each guide arm 90 has a distal free end 90*a* and a trolley assembly 80 secured to the distal free end 90*a*. Each trolley assembly 80 includes a pair of spaced apart arms 82 that are attached to a guide arm 90. A pair of wheels 84 are supported for rotation on an inward side of each arm 82. Each pair of wheels 84 is configured to engage and roll along an inner flange surface 34*a* on a respective side of a guide rail 32. The illustrated trolley assembly 80 of each guide arm 90 is configured such that the wheels 84 of each pair straddle opposing sides of the guide rail 32. However, embodiments of the present invention are not limited to the configuration of the illustrated trolley assembly 80. Various types of trolley assemblies 80 may be utilized with the guide arms 90, including various numbers and configurations of wheels.

In the illustrated embodiment, a counterweight 100 is movably secured to the lower portion 40*b* of the mast 40. The position of the counterweight 100 relative to the mast 40 is adjustable so as to maintain the mast 40 plumb as the mast 40 is raised and lowered. Electronic equipment mounted on the mast 40, such as the cellular antenna arrays 50 and remote radio unit (RRU) arrays 60 may create an imbalance which may cause the mast 40 to tilt as it is being raised or lowered. The adjustable counterweight 100 can offset any imbalance by repositioning the centroid of the mast 40 and electronic equipment mounted thereto. The counterweight 100 can be moved radially (i.e., outward and inward) relative to the mast 40, and the counterweight 100 can be moved about the axis Ai of the mast 40 in a manner similar to a boat rudder. One or more turnbuckles 102 (FIG. 6) or other adjustment apparatus may be utilized to adjust the position of the counterweight 100 relative to the mast 40.

Figure 7:
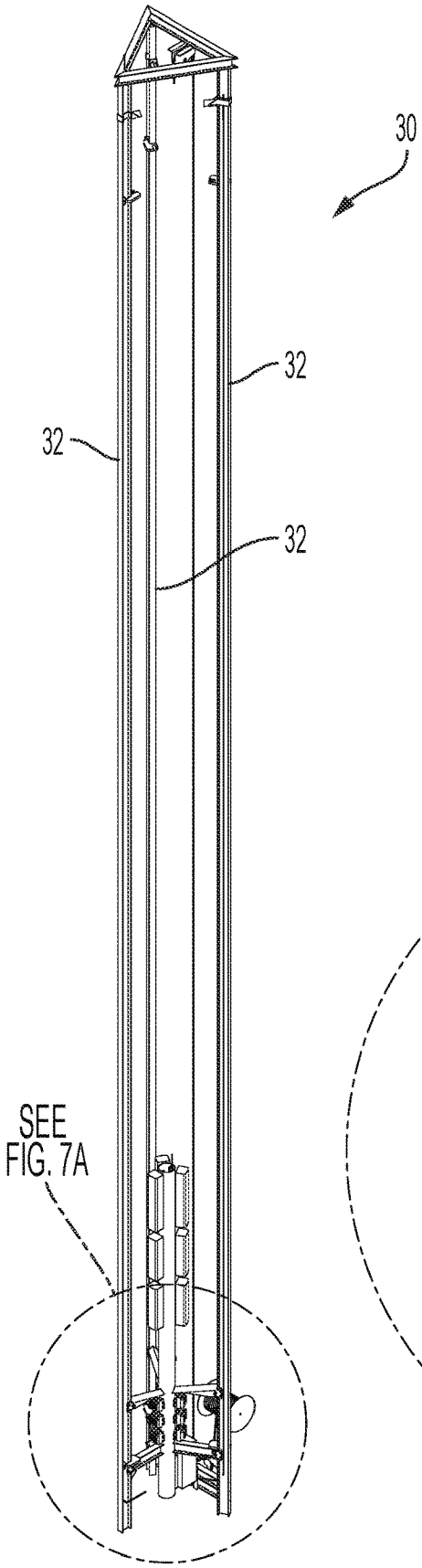
FIG. 7 is a perspective view of the inner structure of FIG. 1, with the outer structure removed for clarity, and with the mast in the lowered position and the lower latches in the closed position.
Figure 7A:
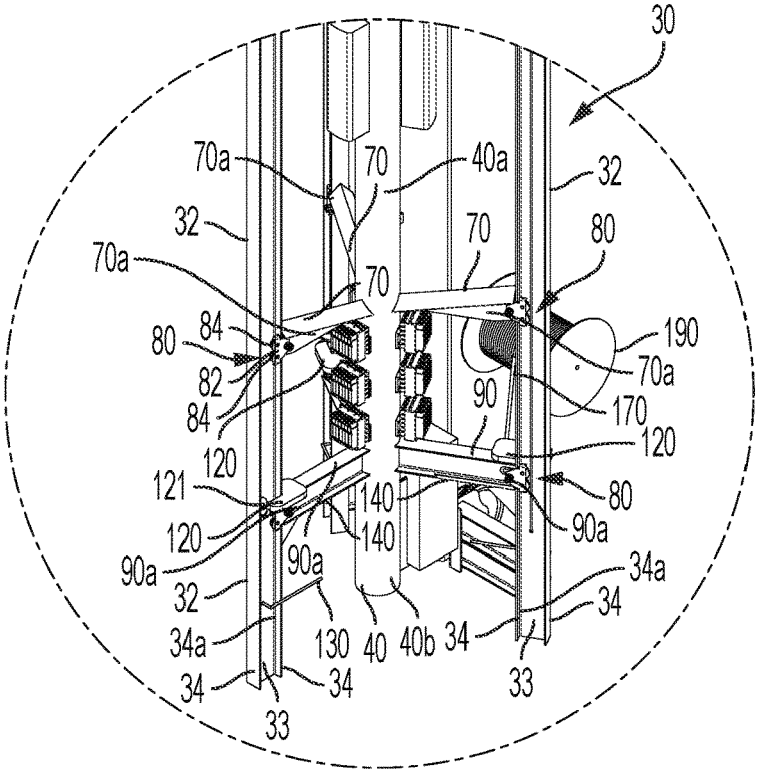
FIG. 7A is an enlarged view of the lower portion of the inner structure of FIG. 7.

Each guide rail 32 of the inner structure 30 includes an upper latch 110 (FIG. 5C) movably secured to the guide rail upper portion 32*b*, and a lower latch 120 (FIG. 5D) movably secured to the guide rail lower portion 32*a*. The upper latch 110 and the lower latch 120 are configured to pivot between open and closed positions via respective hinges 111, 121 that are secured to each guide rail 32. FIG. 11A illustrates the upper latch 110 of each guide rail 32 pivoted via hinge 111 to the open position, and FIG. 12A illustrates the upper latch 110 of each guide rail 32 pivoted via hinge 111 to the closed position. FIG. 7A illustrates the lower latch 120 of each guide rail 32 pivoted via hinge 121 to the closed position, and FIG. 8A illustrates the lower latch 120 of each guide rail 32 pivoted via hinge 121 to the open position. As will be described below, the upper latch 110 of each guide rail 32 is configured to support a respective guide arm 90 when the mast 40 is in the raised position and thereby support the mast 40 in the raised position.

Each upper latch 110 and lower latch 120 may be formed from steel plate and may have a configuration that is configured to cooperate with the inner flange 34 of a respective guide rail 32. For example, as illustrated in FIG. 11A, each upper latch 110 has a cut-out or notch 112 that allows the latch 110 to pivot approximately ninety degrees (90°) between open and closed positions. When in the closed position, the notch 112 of each latch 110 abuts the inner flange 34 of each guide rail 32, as illustrated in FIG. 12A. Similarly, as illustrated in FIG. 8A, each lower latch 120 has a cut-out or notch 122 that allows the latch 120 to pivot approximately ninety degrees (90°) between open and closed positions. When in the closed position, the notch 122 of each latch 120 abuts the inner flange 34 of each guide rail, as illustrated in FIG. 7A.

A latch actuator 131 is operably associated with the upper latch 110 and the lower latch 120 of each guide member, and is configured to be operated manually by a technician standing on the ground via an operating lever 130 (FIG. 7A) extending from each guide rail 32 during raising and lowering operations for the mast 40. In the illustrated embodiment, the actuator 131 is an elongate, rotatable rod which can translate motion of the operating lever 130 into pivotal movement of the upper and lower latches 110, 120 about the respective hinges 111, 121. An exemplary mechanism is a "Turner switch", which is well known in the art of the present invention. In some embodiments, the latch actuator 131 is configured to move the upper latch 110 and the lower latch 120 of each guide rail 32 between the open and closed positions in tandem. However, in other embodiments, the upper latch 110 and the lower latch 120 may move between the open and closed positions independently.

Figure 9:
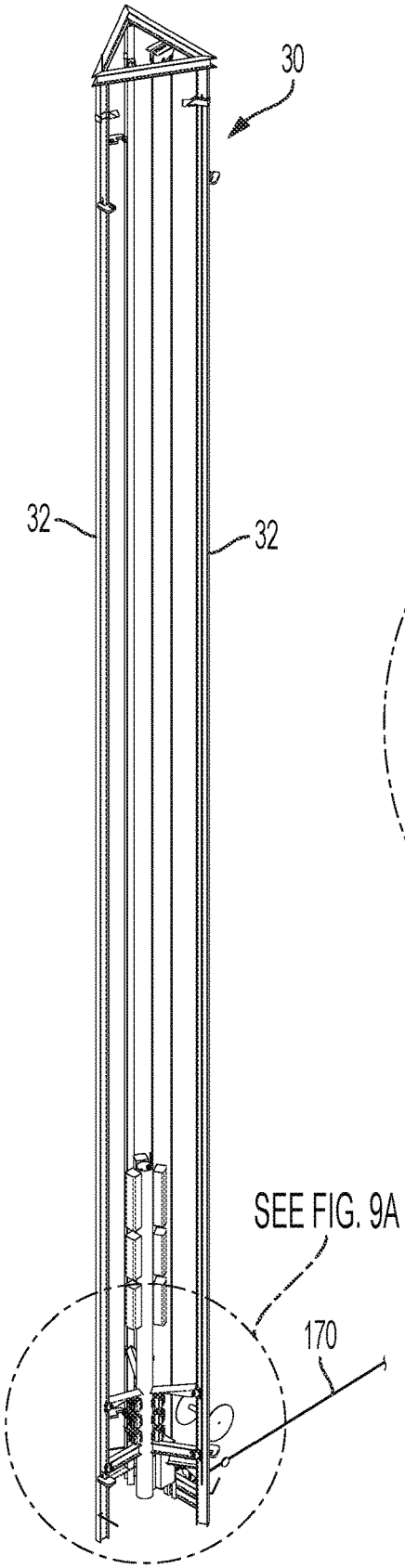
FIG. 9 is a perspective view of the inner structure of FIG. 1, with the outer structure removed for clarity, and with the mast in the initial stages of being raised from the lowered position, and illustrating the guide arms slightly raised from the mast support saddles.
Figure 9A:
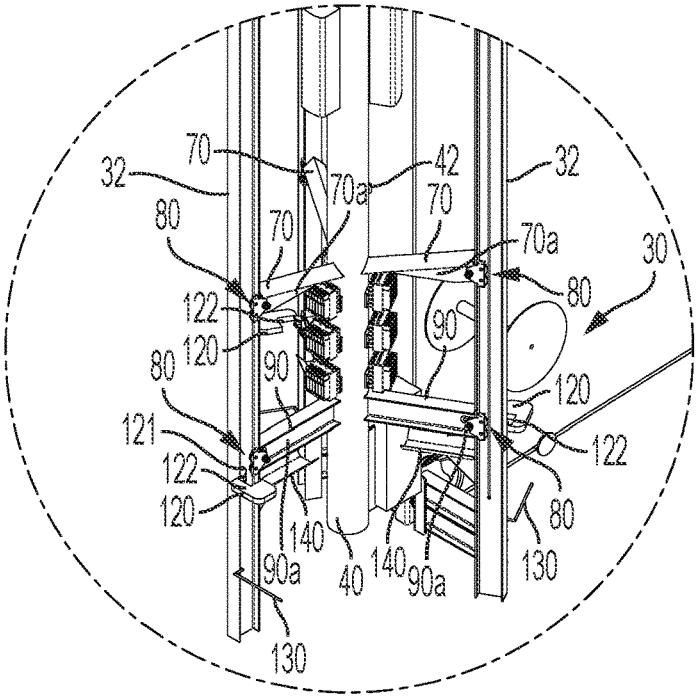
FIG. 9A is an enlarged view of the lower portion of the inner structure of FIG. 9.

Each guide rail 32 also includes a mast support saddle 140 (FIGS. 5A, 9A) extending from a lower portion 32*a* thereof. Each mast support saddle 140 is configured to receive and support a respective guide arm 90 when the mast 40 is in the lowered position. FIG. 7A illustrates the mast 40 in a lowered position and supported by the mast support saddles 140. FIG. 9A illustrates the mast 40 raised slightly from the mast support saddles 140. The mast support saddles 140 support the mast 40 and are positioned such that technicians can access the equipment on the mast 40 from ground level Each mast support saddle 140 may be a steel plate or channel sized and configured to receive a guide arm 90 therein. The mast support saddles 140 may be secured to the mast 40 via welding or mechanical fasteners, or via a combination of welding and mechanical fasteners.

Each guide rail 32 also includes a docking clamp 150 (FIG. 5C) that is movably secured to the guide rail upper portion 32*b*. The docking clamps 150 are configured to restrain the mast 40 when the mast 40 is in the raised position by engaging the docking arms 70 and preventing vertically upward movement as well as other translational movement of the mast 40. Each docking clamp 150 may be a steel member having a shape corresponding to the shape of a respective docking arm 70 such that the docking arm 70 is matingly received within the docking clamp 150 when the mast 40 is in the raised position. In the illustrated embodiment, each docking clamp 150 is movable up and down on a respective guide rail 32 by a respective sleeve 151 that matingly engages the guide rail 32. An elongate rod 152 is utilized to raise and lower each sleeve 151 and docking clamp 150 by a technician standing on the ground.

Figure 5:
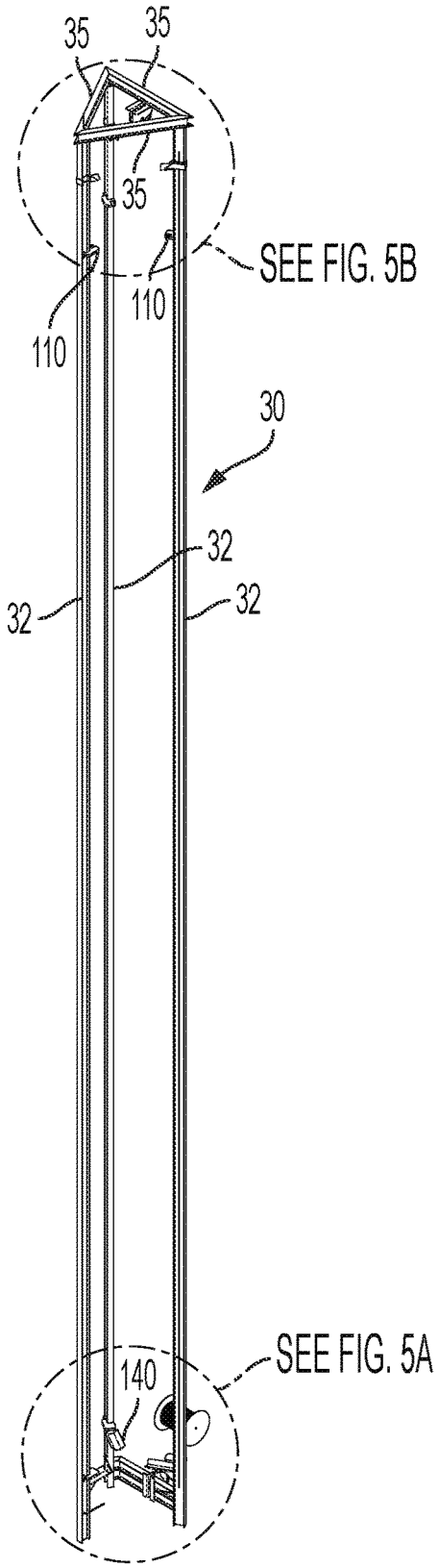
FIG. 5 is a top perspective view of the inner structure of the tower of FIG. 1, with the outer structure and the mast removed for clarity.
Figure 5B:
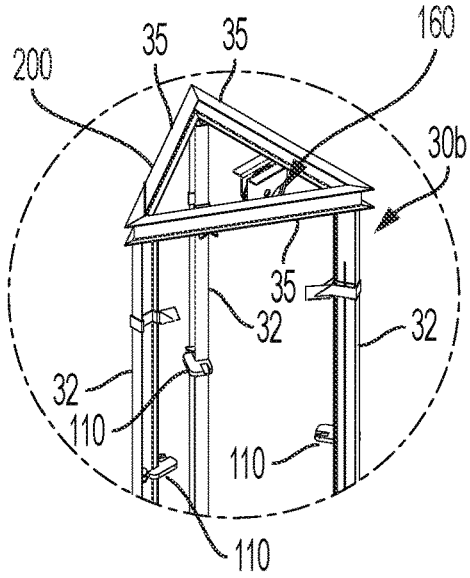
FIG. 5B is an enlarged view of the upper portion of the inner structure of FIG. 5.
Figure 5A:
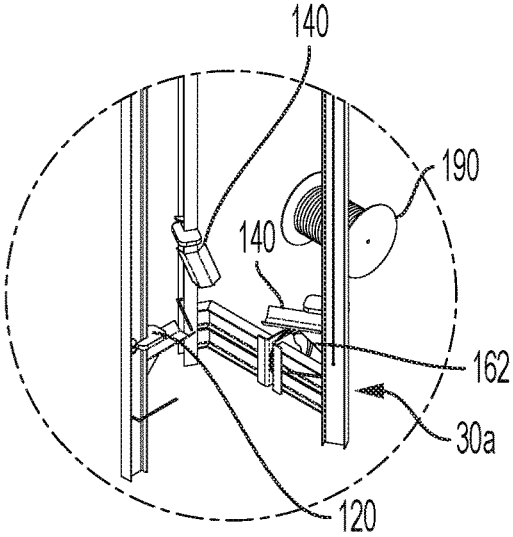
FIG. 5A is an enlarged view of the lower portion of the inner structure of FIG. 5.
Figure 5C:
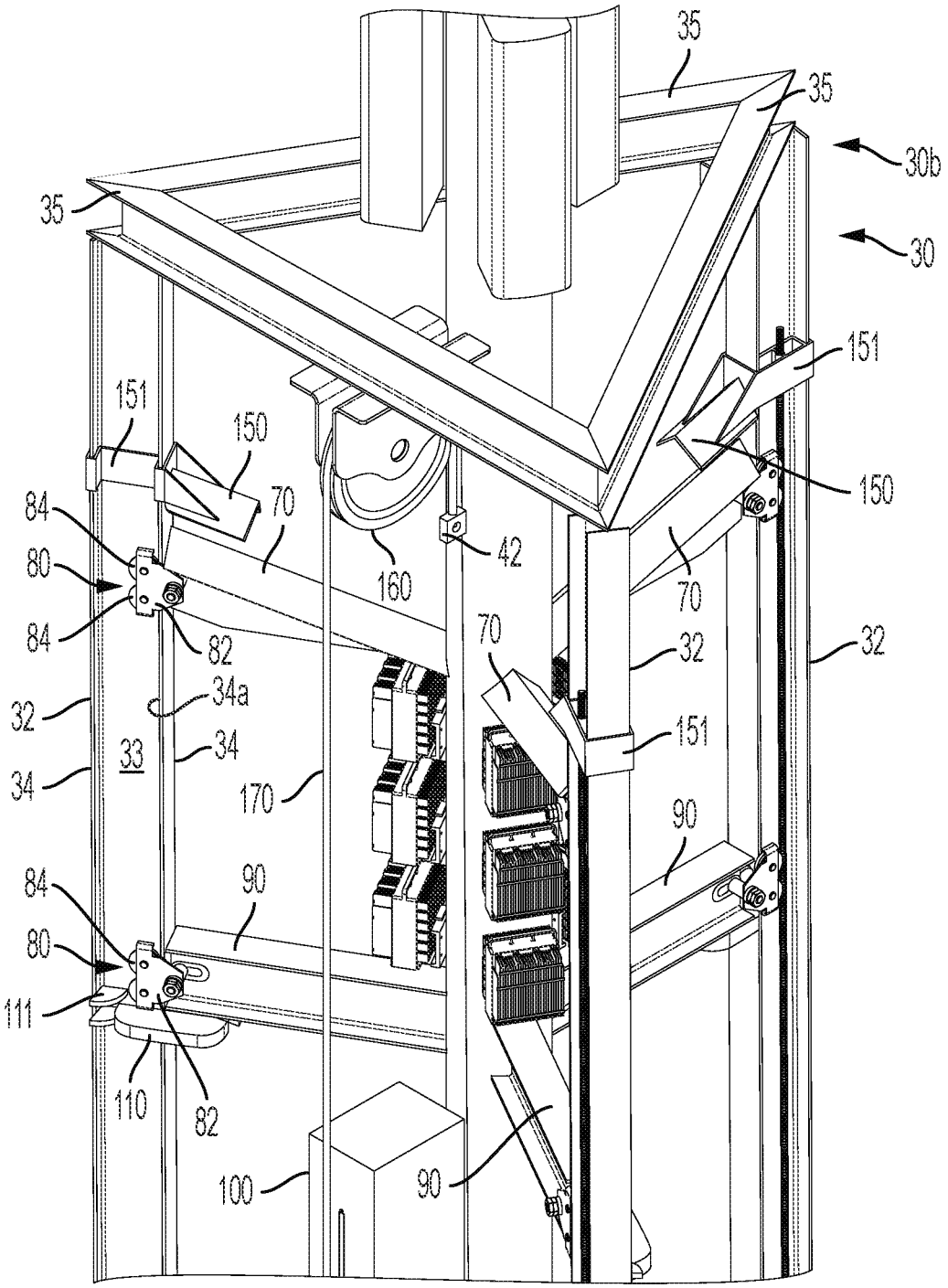
FIG. 5C is a partial perspective view of the upper portion of the inner structure of FIG. 2.
Figure 5D:
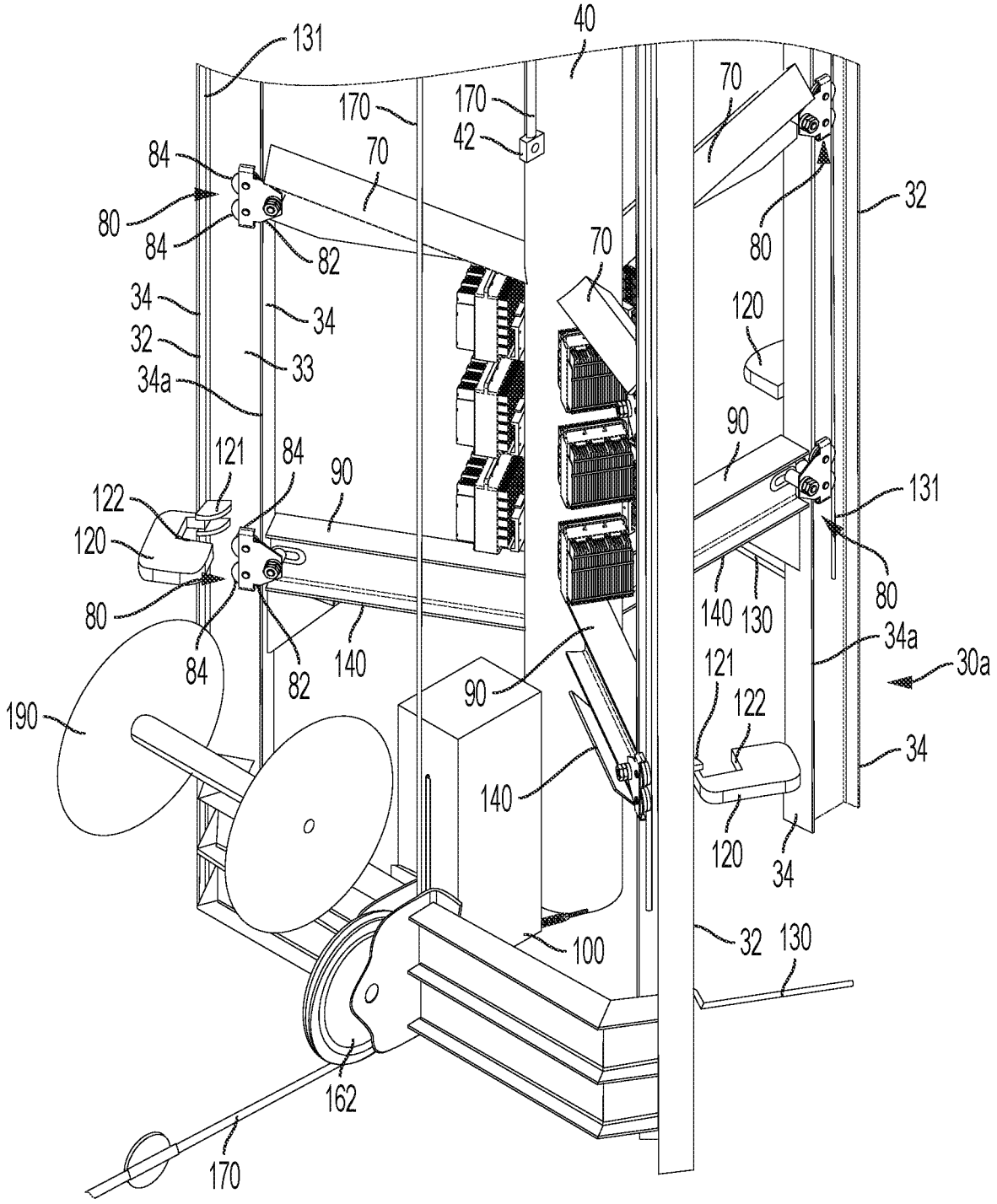
FIG. 5D is a partial perspective view of the lower portion of the inner structure of FIG. 3.
Figure 5E:
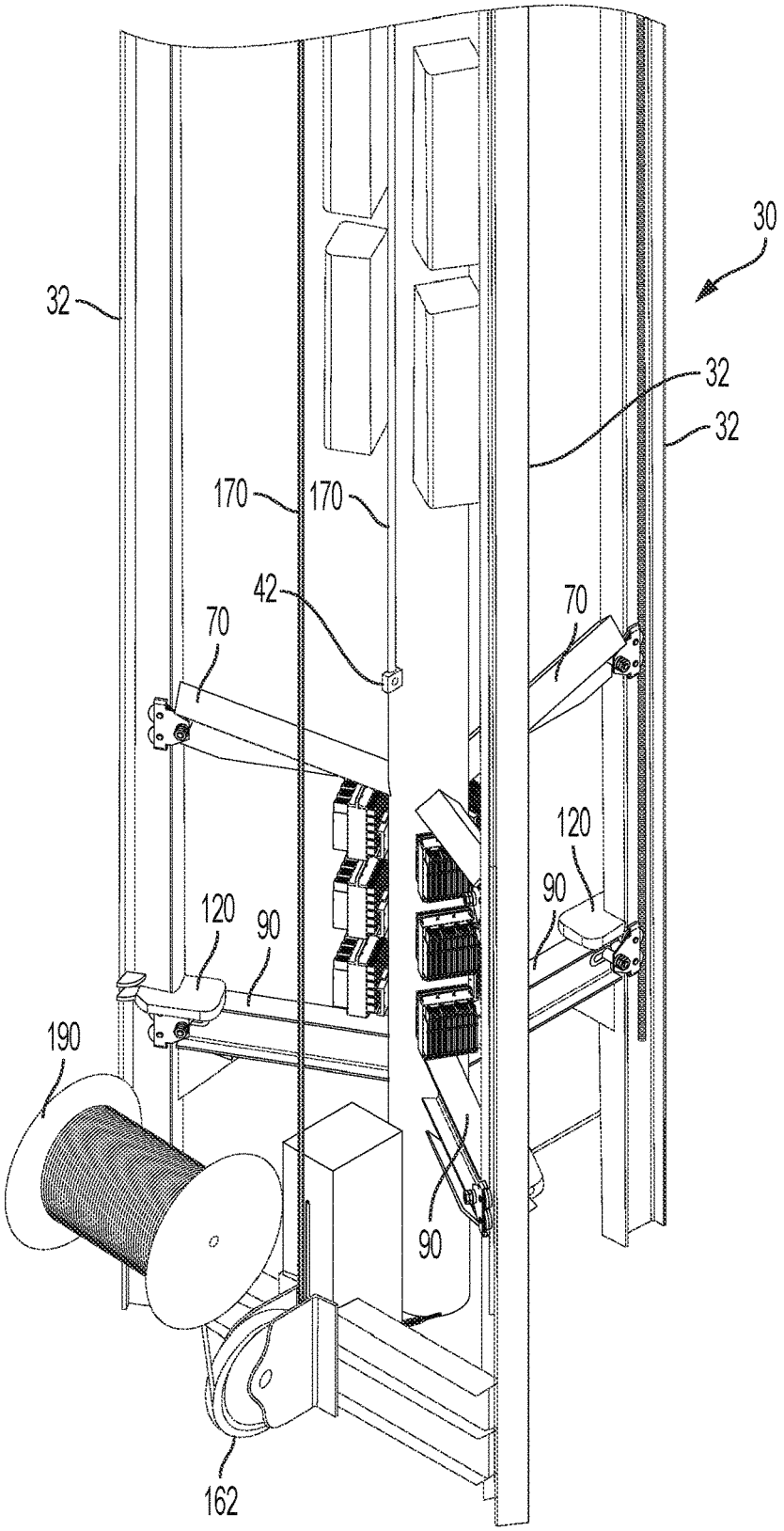
FIG. 5E is a partial perspective view of the lower portion of the inner structure of FIG. 3 and illustrating the lifting cable wound around the storage spool.
Figure 13:
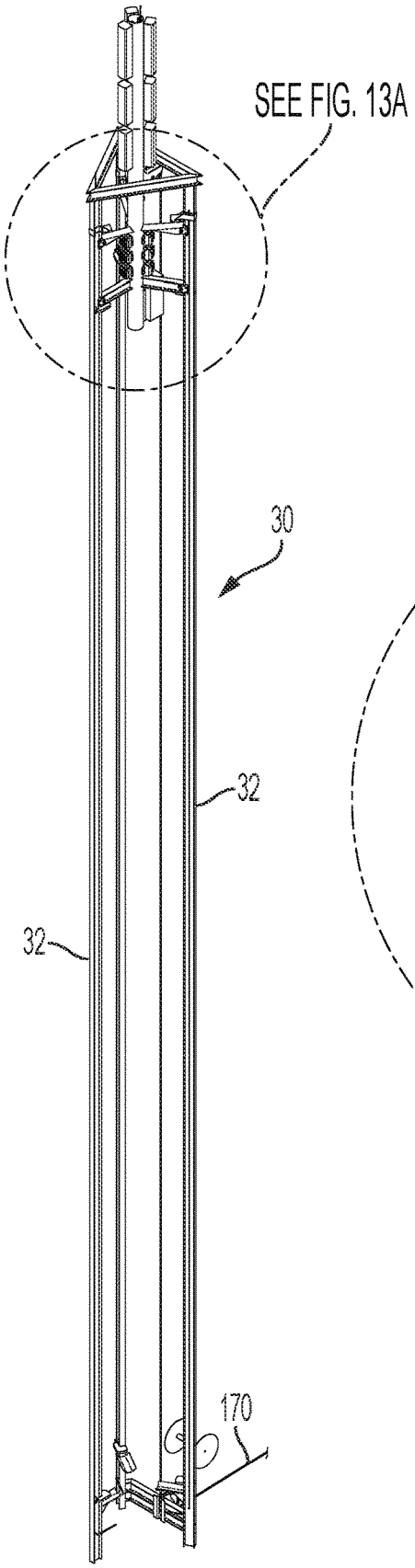
FIG. 13 is a perspective view of the inner structure of FIG. 1, with the outer structure removed for clarity, and with the mast in the raised position and being supported by the upper latches.
Figure 13A:
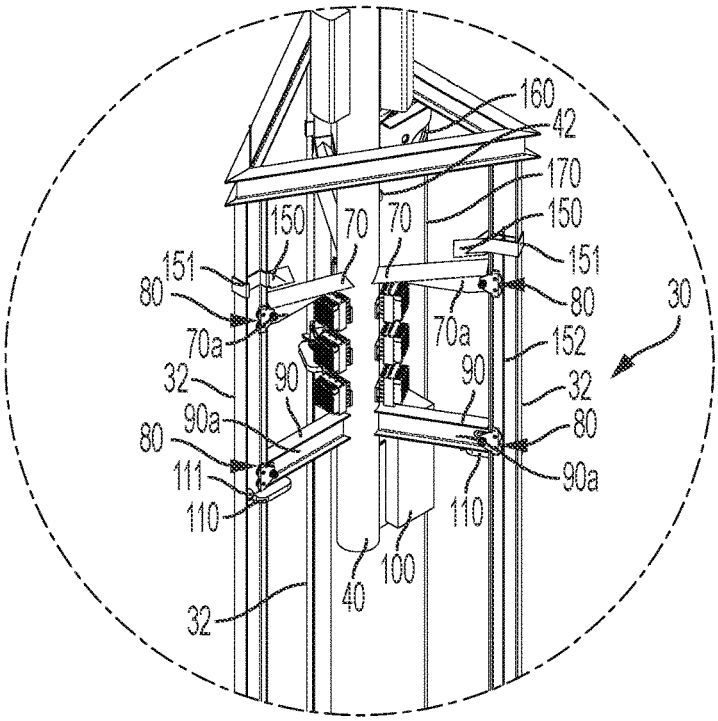
FIG. 13A is an enlarged view of the upper portion of the inner structure of FIG. 13.
Figure 14:
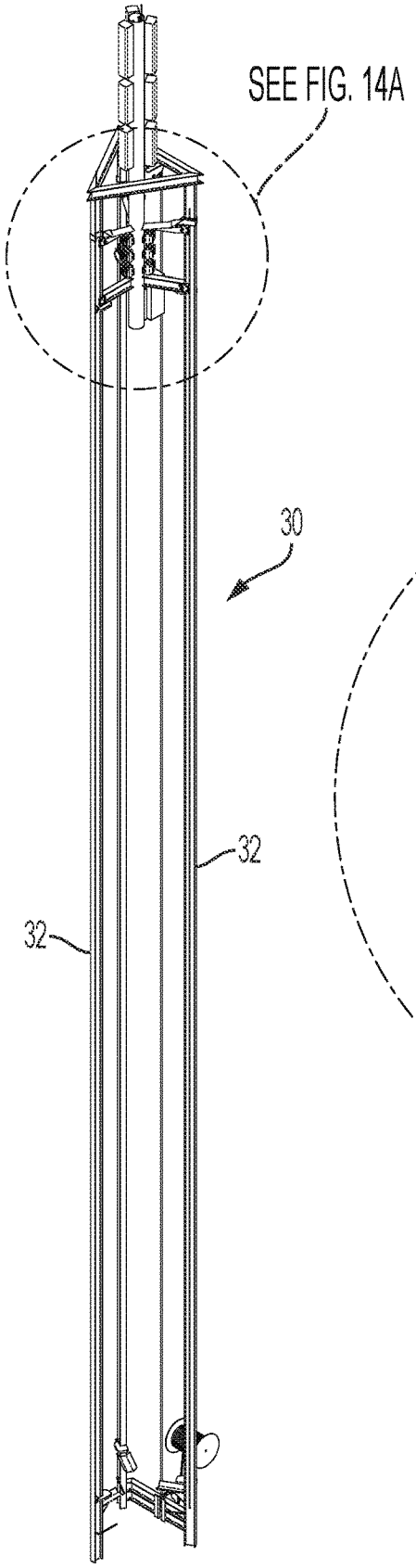
FIG. 14 is a perspective view of the inner structure of FIG. 1, with the outer structure removed for clarity, and with the mast in the raised position, being supported by the upper latches, and with the docking clamps lowered to engage the docking members.
Figure 14A:
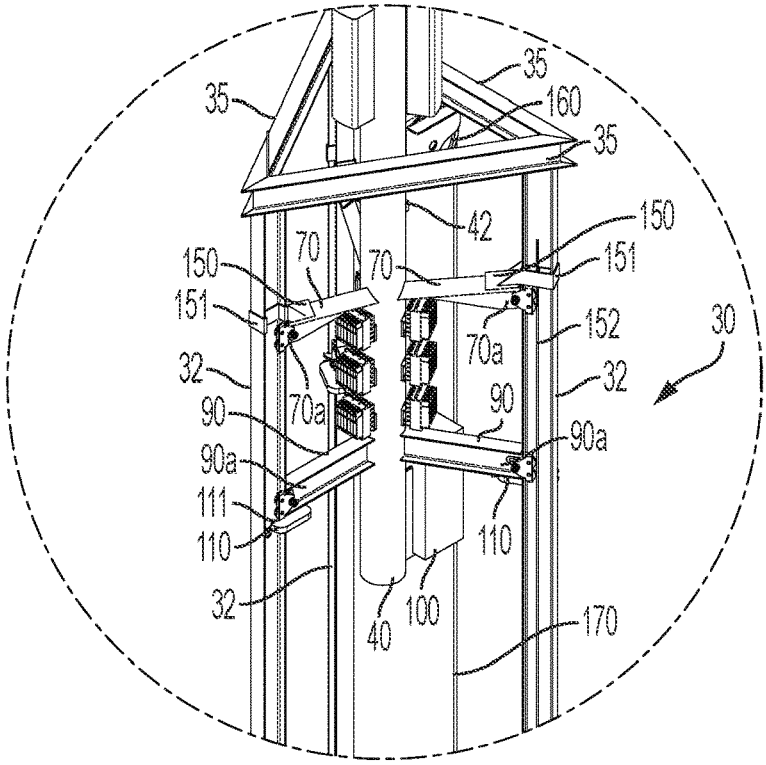
FIG. 14A is an enlarged view of the upper portion of the inner structure of FIG. 14.

A first sheave or pulley wheel 160 is rotatably mounted to the upper end 30*b* of the inner structure 30, as illustrated in FIGS. 5B and 5C, and a second sheave or pulley wheel 162 is rotatably mounted to the lower end 30*a* of the inner structure 30, as illustrated in FIGS. 5A and 5D. A lifting cable 170, such as a rope, is threaded over and rides on both pulley wheels 160, 162. One end of the lifting cable 170 is attached to the mast 40 via a lifting lug 42 (FIG. 5C), and the other end is windably received on a spool 182 of a winch system 180 (FIG. 3) during raising and lowering operations of the mast 40. Intermediate guides (not illustrated) may also be utilized at various locations on the inner structure 30 to manage the direction of the lifting cable 170. When the lifting cable 170 is not needed, for example when the mast 40 is in either the raised position or the lowered position, the lifting cable 170 can be wound around a storage spool 190 (FIG. 5E) located at the lower end 30*a* of the inner structure 30. The lifting cable 170 is not needed when the mast 40 is in the lowered position, as illustrated in FIG. 5E or when the mast 40 is in the raised position and supported by the upper latches 110, as illustrated in FIGS. 5C, 13A and 14A. The lifting cable 170 is illustrated being wound around the storage spool 190 in FIGS. 1, 2, 4 and 14 when the mast 40 is in the raised position and supported by the upper latches 110. Similarly, the lifting cable 170 is illustrated being wound around the storage spool 190 in FIGS. 5E and 7A when the mast 40 is in the lowered position and supported by the support saddles 140.

In some embodiments, the lifting cable 170 is a non-conductive, high tensile strength rope formed from any of various polymeric materials such as, but not limited to, nylon and polypropylene. In some embodiments, the lifting cable 170 may have a diameter of two and a half inches (2.5"), although other sizes may be utilized.

Air terminals (i.e., lightning rods) 200 (FIG. 1) are utilized on both the movable mast 40 and the outer and inner structures 20, 30 with separate bonding to earth ground. These separate air terminals 200 may be necessary to prevent lightning strike energy from fusing (welding) parts of the mast 40 to parts of the inner structure 30.

Movement of the mast 40 from the lowered position to the raised position will now be described. Referring to FIGS. 7 and 7A, the mast 40 is in the lowered position and the guide arms 90 are supported by the support saddles 140. As shown in FIG. 7A, the lower latches 120 are in the closed position to prevent inadvertent upward movement of the mast 40. In addition, the lifting cable 170 is illustrated being wound around the storage spool 190 (i.e., the lifting cable 170 is in a stored configuration).

Figure 3:
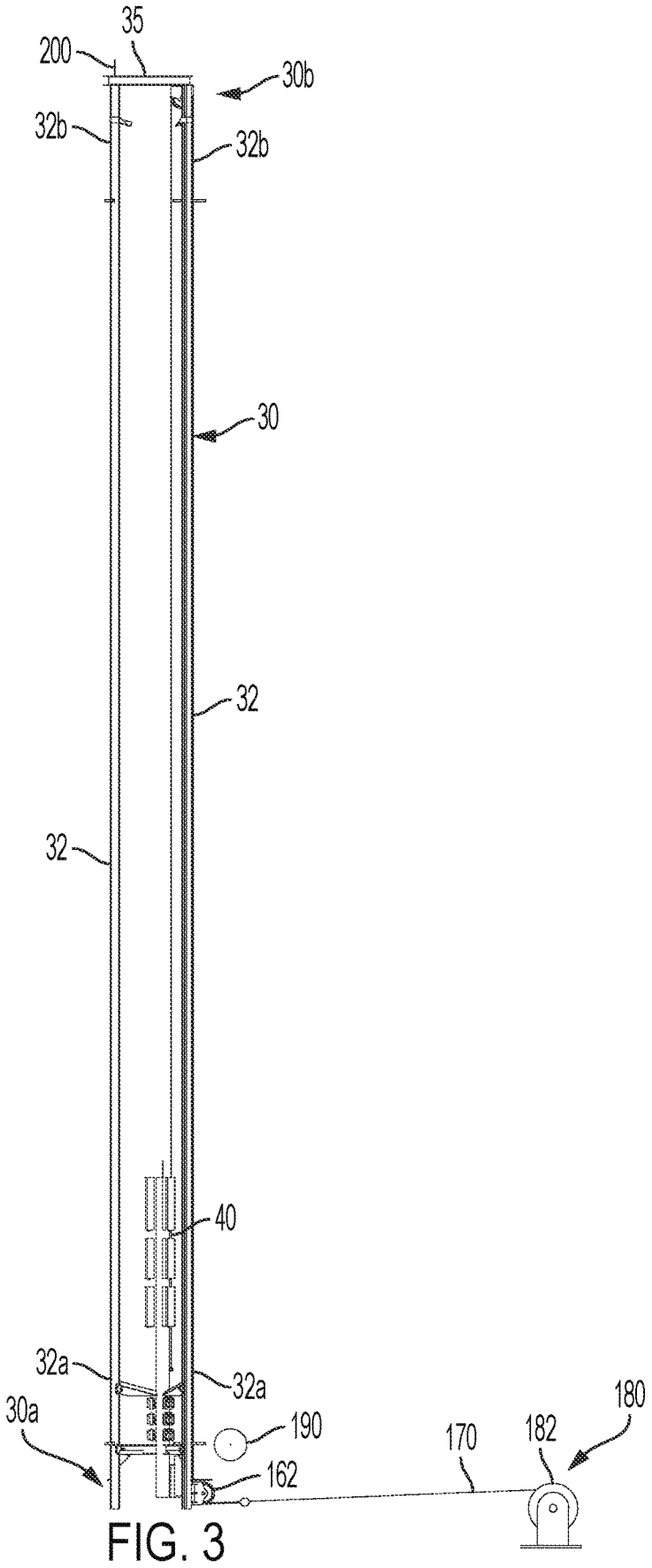
FIG. 3 is a front view of the inner structure of the tower of FIG. 1, with the outer structure removed for clarity, and illustrating the mast in the lowered position.
Figure 4:
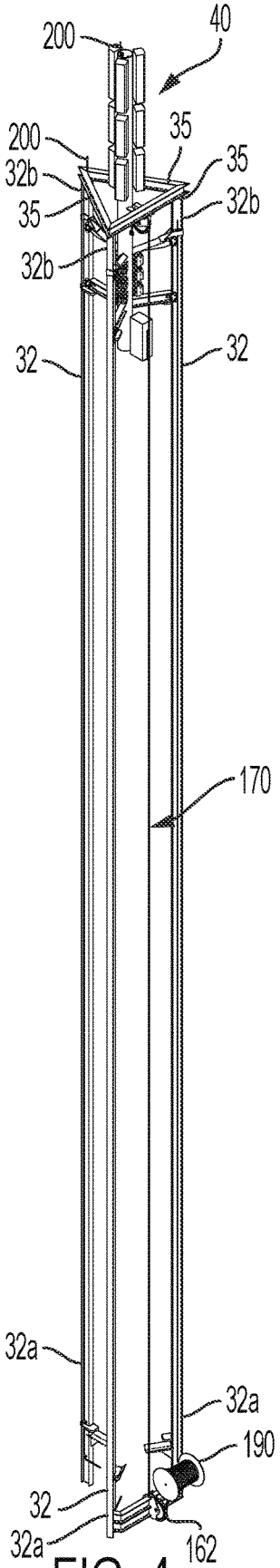
FIG. 4 is a top perspective view of the inner structure of the tower of FIG. 1, with the outer structure removed for clarity, and illustrating the mast in the raised position.
Figure 8:
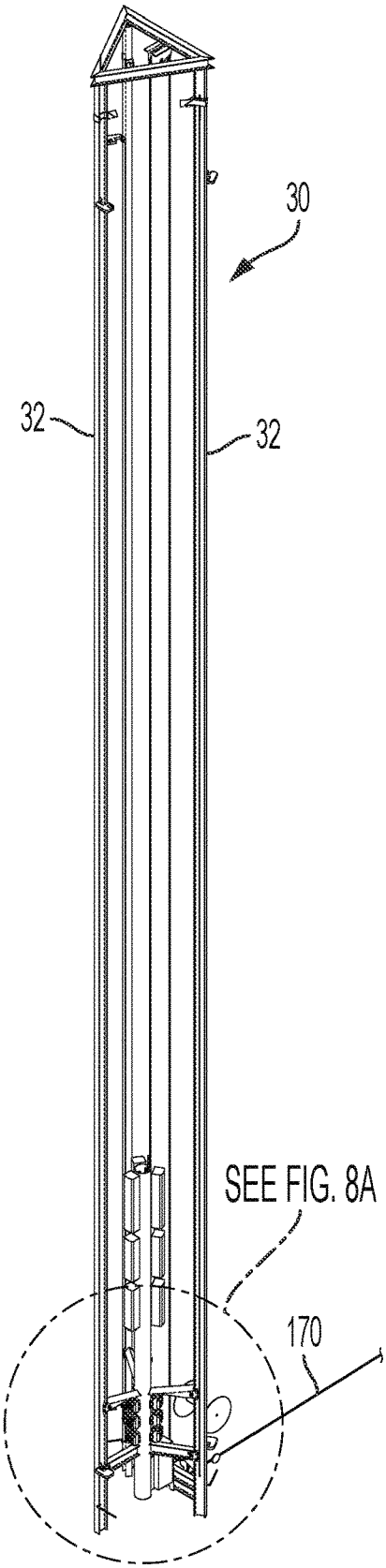
FIG. 8 is a perspective view of the inner structure of FIG. 1, with the outer structure removed for clarity, and with the mast in the lowered position and the lower latches in the open position.
Figure 8A:
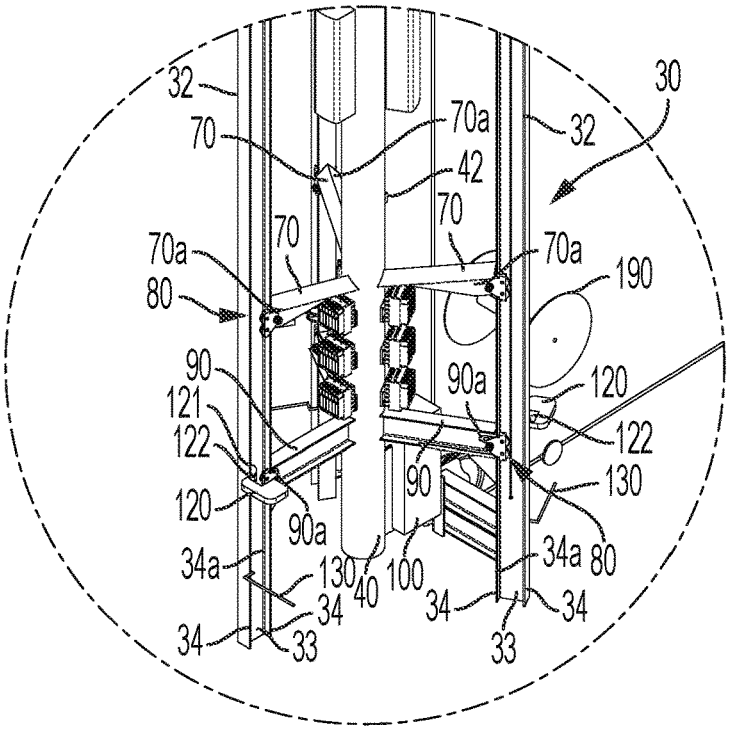
FIG. 8A is an enlarged view of the lower portion of the inner structure of FIG. 8.
Figure 10:
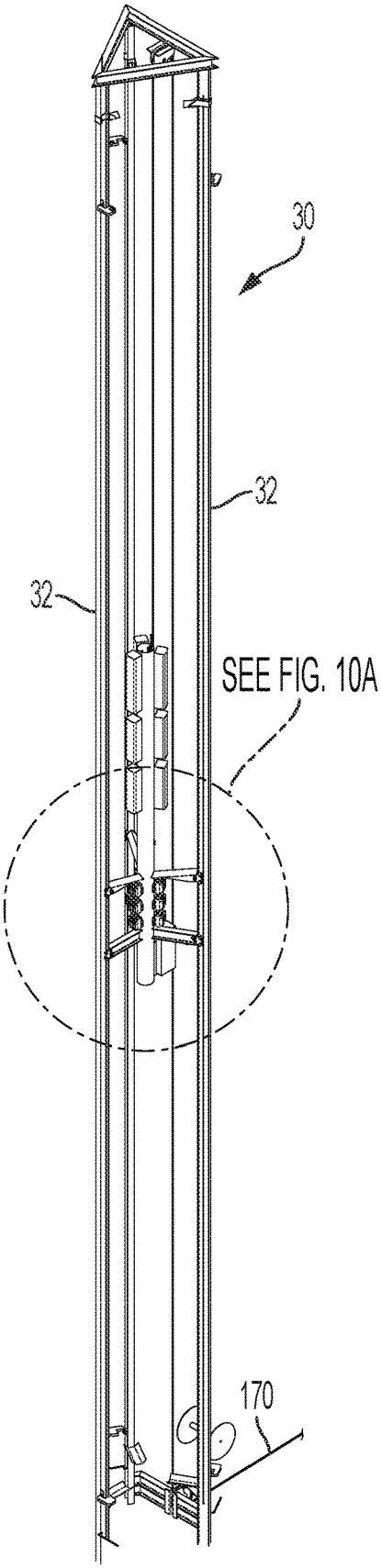
FIG. 10 is a perspective view of the inner structure of FIG. 1, with the outer structure removed for clarity, and illustrating the mast approximately half way between the lowered position and the raised position.
Figure 10A:
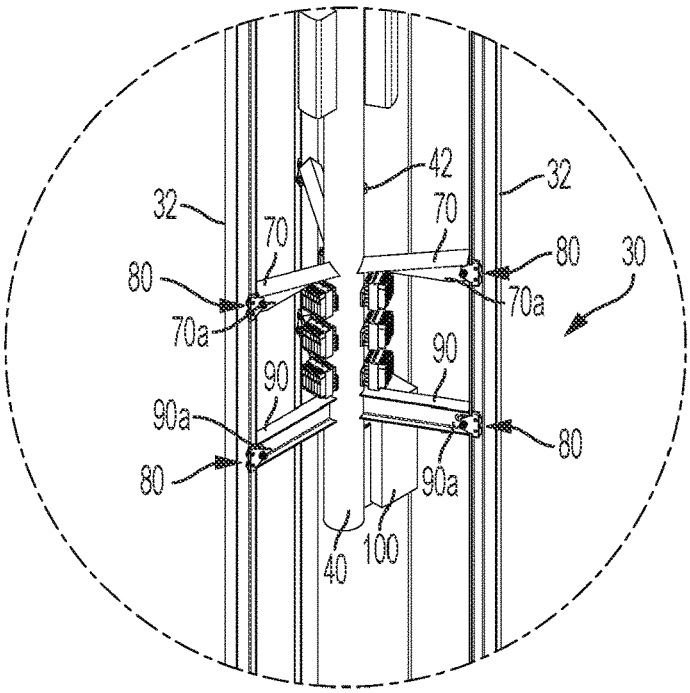
FIG. 10A is an enlarged view of the medial portion of the inner structure of FIG. 10.

To raise the mast 40, the lower latches 120 are pivoted about their respective hinges 121 to an open position, as illustrated in FIGS. 8 and 8A. In addition, the lifting cable 170 is unwound from the storage spool 190 and an end thereof is operably engaged with a cable tension measuring device, such as a dynamometer. The dynamometer is then attached to the winch line extended from the spool 182 of a winch system 180 (FIG. 3). Such a winch system 180 may be a mobile system provided via a truck or other vehicle. However, in some embodiments of the present invention, the winch system 180 may be located at the site of the tower 10. The other end of the lifting cable 170 remains attached to the mast 40 via the lifting lug 42 (FIG. 5C). Operation of the winch system 180 then begins as remote readout of the dynamometer indicates increasing winch line tension. When the dynamometer reading equals the previously determined design force of lifting, i.e., weight of the moving assembly and friction, observation of clearances between guide rails 32 and companion trolley assemblies 80 will commence. As winch line tension is increased, applying force necessary to fully neutralize the resistance to lifting, mast 40 will be perceptibly separated from all maintenance saddles 140. At that time, lifting motion will be paused while technicians adjust the position of the counterweight 100, normalizing clearances between guide rails 32 and companion trolley assemblies 80 to be symmetrical and uniform, thereby causing the mast 40 to be vertically plumb. Lifting motion will then resume. Winch line tension known via dynamometer readings or other metrics will be maintained as the lifting continues and the mast 40 is slowly raised from the mast support saddles 140, as illustrated in FIGS. 9 and 9A. Monitoring of dynamometer readings to remain within safe margins will continue as mast 40 is raised. FIGS. 10 and 10A illustrate the mast 40 after it has been raised approximately half-way between the lowered position and the raised position.

Figure 11:
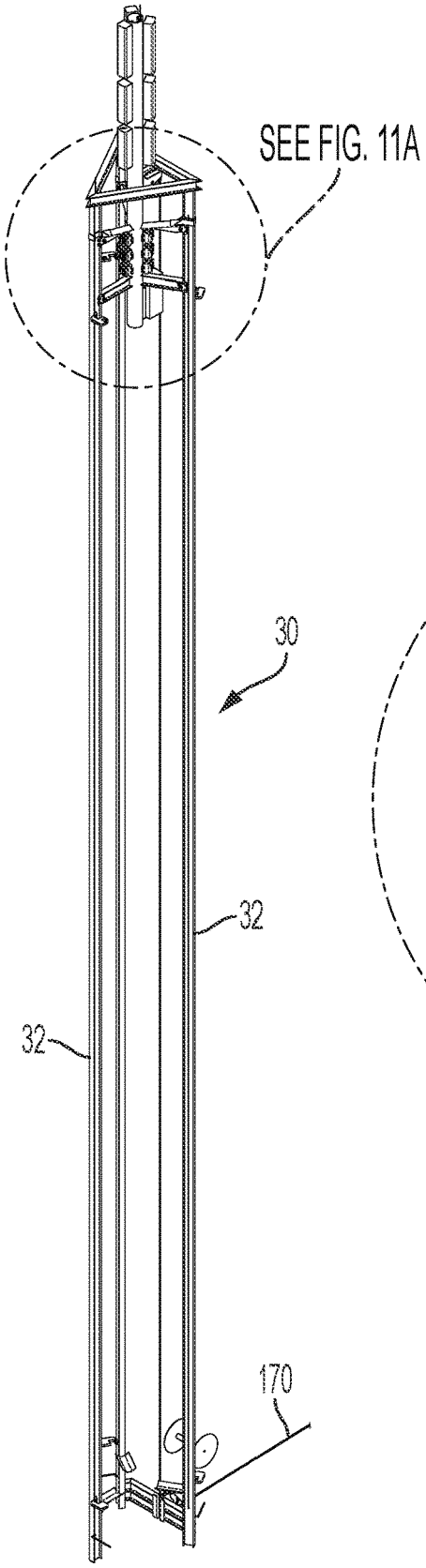
FIG. 11 is a perspective view of the inner structure of FIG. 1, with the outer structure removed for clarity, and with the mast in the raised position and the upper latches in the open position.
Figure 11A:
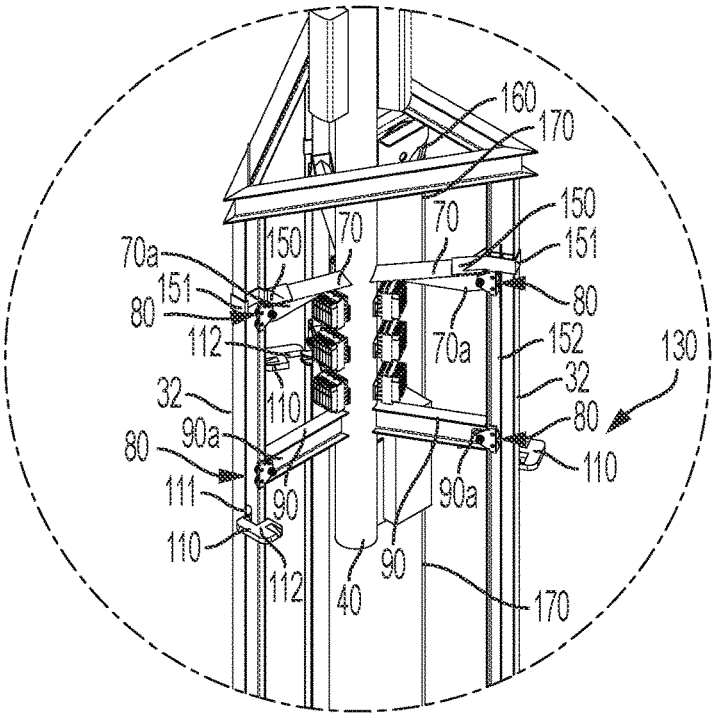
FIG. 11A is an enlarged view of the upper portion of the inner structure of FIG. 11.
Figure 12:
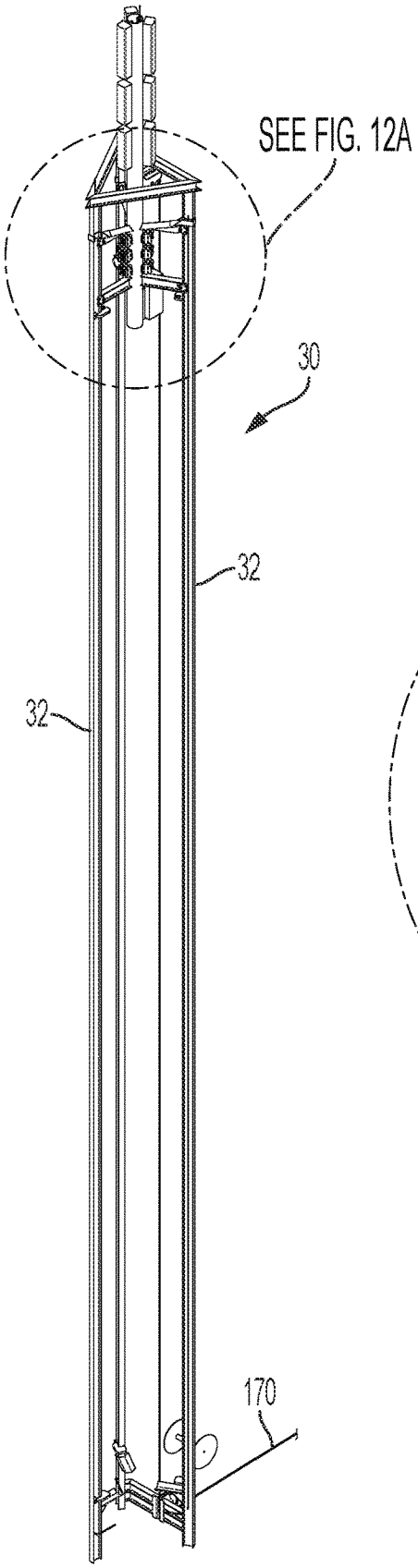
FIG. 12 is a perspective view of the inner structure of FIG. 1, with the outer structure removed for clarity, and with the mast in the raised position and the upper latches in the closed position.
Figure 12A:
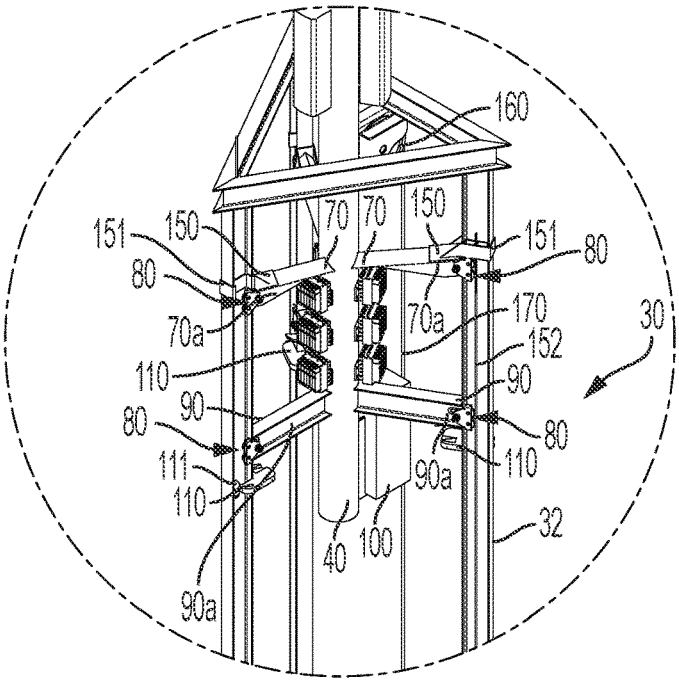
FIG. 12A is an enlarged view of the upper portion of the inner structure of FIG. 12.

Referring to FIGS. 11 and 11A, the upper latches 110 are pivoted via respective hinges 111 to the open position and the mast 40 is raised slightly above the location of each of the upper latches 110. The docking clamps 150 serve as stops to prevent the mast 40 from being raised too far. Dynamometer readings will increase and lifting motion will stop when mast 40 contacts docking clamps 150. The upper latches 110 are then pivoted via respective hinges 111 to the closed position, as illustrated in FIGS. 12 and 12A. The mast 40 is then lowered via the winch system 180 until the guide arms 90 come to rest upon the upper latches 110, as illustrated in FIGS. 13 and 13A. The mast 40 is now in the final raised position and the entire weight of the mast 40 is supported by the upper latches 110. The docking clamps 150 are then lowered to engage the docking members 70 and restrain the mast 40 from movement, as illustrated in FIGS. 14 and 14A. The end of the lifting cable 170 wound about the spool 182 of the winch system 180 can be removed from the winch system spool and then can be wound about the storage spool 190 until needed in the future.

To lower the mast 40 from the raised position to the lowered position, the above-described operations are reversed.

Figure 15:
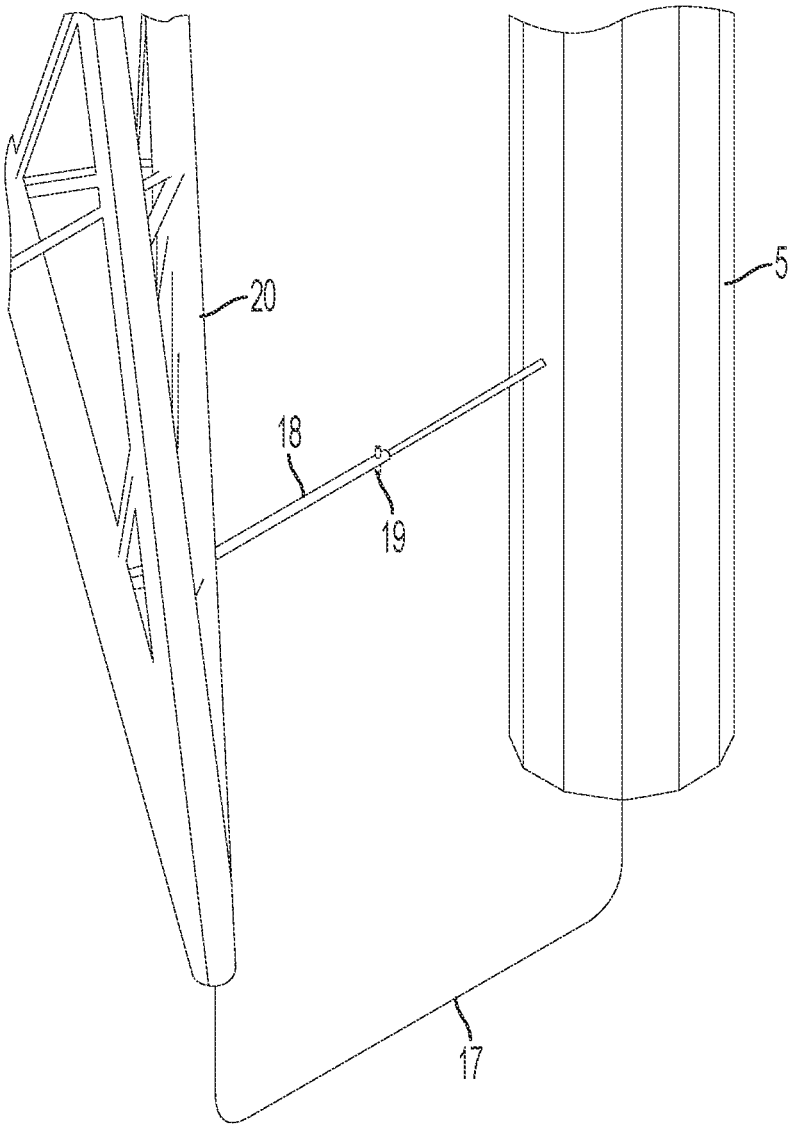
FIG. 15 is a partial perspective view of the tower of FIG. 1 illustrating the member connecting the outer structure of the tower to the adjacent electrical transmission tower, and also illustrating the electrical connection therebetween, according to some embodiments of the present invention.

In the illustrated embodiment of FIG. 1, the tower 10 is adjacent an electrical power transmission tower 5, and the outer structure 20 is attached to the transmission tower 5 via a structural member 18 extending from the outer structure 20. In addition, the tower 10 is electrically grounded to the adjacent electrical power transmission tower 5 via a grounding connection 17 (FIGS. 1 and 15) between the outer structure 20 and the transmission tower 5. The tower 10 can be positioned adjacent the transmission tower 5 in various orientations and is not limited to the illustrated orientation. In addition, the tower 10 may be secured to the transmission tower 5 with any number of structural members 18. Each structural member 18 may include a shear pin 19 (FIG. 15), or other breakable element, that will prevent either tower from toppling the other. For example, should the transmission tower 5 be toppled or otherwise move as a result of high wind or because of an earthquake, etc., the structural member 18 is configured to break away via the shear pin 19 such that the two towers 10 and 5 are no longer structurally connected to each other. As such, severe movement or toppling of one tower cannot cause severe movement or toppling of the other tower.

Towers 10 according to embodiments of the present invention are not limited to being located next to a transmission tower. Towers 10 according to embodiments of the present invention may be located next to various other external structures, such as electrical power distribution towers, electrical substation structures, etc.

Figure 16:
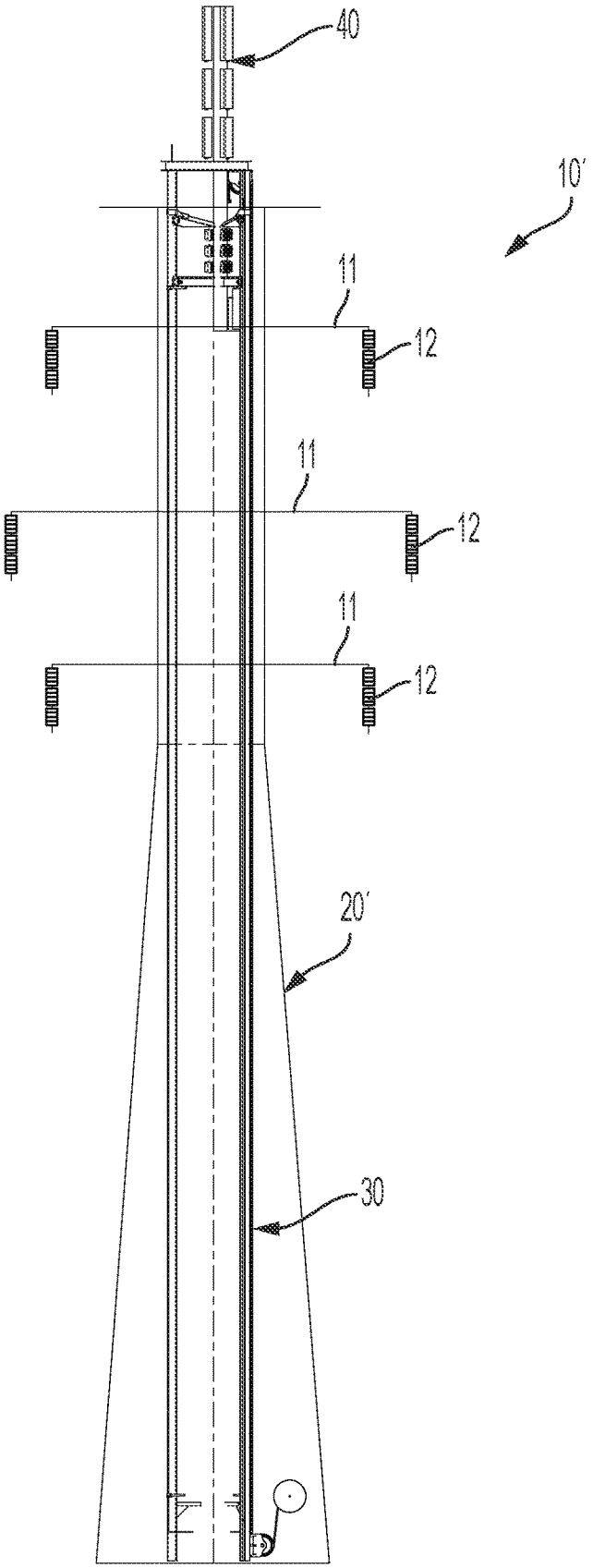
FIG. 16 is a front view of a tower according to some embodiments of the present invention and wherein the outer structure is an electrical power transmission tower.

In some embodiments, towers according to embodiments of the present invention may replace transmission/distribution towers with moderate upgrades so as to support electrical power transmission lines. FIG. 16 illustrates a tower 10' according to some embodiments of the present invention wherein the outer structure 20' is configured as an electrical power transmission tower with cross-arms 11 and insulators 12 for supporting electrical power transmission lines (i.e., wires). The illustrated outer structure 20' is a 4-leg electrical transmission exoskeleton, although other configurations may be utilized. Although not illustrated, the outer structure 20' will include triangulating reinforcement members, as would be understood by one of skill in the art. The illustrated outer structure 20' may have various shapes and configurations and may support various numbers and types of electrical transmission lines. Embodiments of the present invention are not limited to the illustrated configuration in FIG. 16.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A tower, comprising:

an outer lattice structure comprising a lower end configured to be anchored to the ground, and an opposite upper end;

an inner structure positioned within the outer lattice structure and connected to the outer lattice structure, the inner structure comprising a lower end configured to be anchored to the ground and an opposite upper end;

a mast movable within the inner structure between a lowered position and a raised position, wherein the mast is configured to support electronic equipment; and a counterweight movably secured to a lower portion of the mast, wherein a position of the counterweight relative to the mast is adjustable so as to maintain the mast plumb as the mast is raised and lowered, and wherein the counterweight is movable radially relative to the mast and/or movable about an axis of the mast.

2. The tower of claim 1, wherein the mast is configured to support one or more of the following: a cellular antenna array, a remote radio unit (RRU) array, a microwave antenna, imaging equipment, an acoustic sensor, a tectonic or motion sensor, a thermal sensor, a chemical sensor, a nuclear sensor, and wherein at least a portion of the mast extends through the upper end of the inner structure and the upper end of the outer lattice structure when the mast is in the raised position.

3. The tower of claim 1, wherein the inner structure comprises a plurality of spaced, parallel guide rails, each guide rail having opposite upper and lower end portions, each guide rail comprising:

an upper latch movably secured to the guide rail upper portion and a lower latch movably secured to the guide rail lower end portion, wherein the upper latch and the lower latch are movable between open and closed positions, wherein the upper latch is configured to support the mast when the mast is in the raised position;

a latch actuator operably associated with the upper latch and the lower latch, wherein the latch actuator is configured to move the upper latch and the lower latch between the open and closed positions; and a mast support saddle configured to support the mast when the mast is in the lowered position.

4. The tower of claim 3, wherein the latch actuator is configured to move the upper latch and the lower latch between the open and closed positions in tandem.

5. The tower of claim 3, wherein each guide rail further comprises a docking clamp movably secured to the guide rail upper end portion, wherein the docking clamp is configured to restrain the mast when the mast is in the raised position.

6. The tower of claim 5, wherein the mast comprises a plurality of docking arms extending outward therefrom, wherein each docking arm is movably connected to a respective guide rail and is movable along the guide rail as the mast is moved between the lowered position and the raised position, and wherein each guide rail docking clamp is configured to move and engage a respective docking arm when the mast is in the raised position.

7. The tower of claim 6, wherein each docking arm comprises a trolley in rolling engagement with a respective guide rail.

8. The tower of claim 7, wherein each guide rail is an I-beam, and wherein each trolley comprises two pairs of wheels, the wheels of each pair straddling opposing sides of the I-beam.

9. The tower of claim 1, wherein the mast comprises a plurality of guide arms extending outward therefrom, wherein each guide arm is movably connected to a respective guide rail and is movable along the guide rail as the mast is moved between the lowered position and the raised position.

10. The tower of claim 9, wherein each guide arm comprises a trolley in rolling engagement with a respective guide rail.

11. The tower of claim 10, wherein each guide rail is an I-beam, and wherein each trolley comprises two pairs of wheels, the wheels of each pair straddling opposing sides of the I-beam.

12. The tower of claim 1, wherein the inner structure upper end comprises a pulley wheel rotatably mounted thereto, and further comprising a lifting cable attached at one end to the mast, wherein the lifting cable is threaded over and rides on the pulley wheel, and wherein the lifting cable is configured to be windably received at an opposite end on a spool of a winch system.

13. The tower of claim 1, further comprising at least one member extending from the outer lattice structure that is configured to be connected to an external structure, wherein the at least one member comprises a breakable element.

14. The tower of claim 13, wherein the outer lattice structure is configured to be electrically grounded to the external structure.

15. The tower of claim 13, wherein the external structure includes one of an electrical power transmission tower, an electrical power distribution tower, and an electrical substation structure.

16. A tower, comprising:

an outer lattice structure comprising a lower end configured to be anchored to the ground, and an opposite upper end;

an inner structure positioned within the outer lattice structure and connected to the outer lattice structure, the inner structure comprising a lower end configured to be anchored to the ground and an opposite upper end; and a mast movable within the inner structure between a lowered position and a raised position, wherein the mast is configured to support electronic equipment;

wherein the inner structure comprises a plurality of spaced, parallel guide rails, each guide rail having opposite upper and lower end portions, each guide rail comprising:

an upper latch movably secured to the guide rail upper portion and a lower latch movably secured to the guide rail lower portion, wherein the upper latch and the lower latch are movable between open and closed positions, wherein the upper latch is configured to support the mast when the mast is in the raised position; and a docking clamp movably secured to the guide rail upper portion, wherein the docking clamp is configured to restrain the mast when the mast is in the raised position;

wherein the mast comprises:

a plurality of docking arms extending outward from the mast, wherein each docking arm is movably connected to a respective guide rail and movable along the guide rail as the mast is moved between the lowered position and the raised position, and wherein each guide rail docking clamp is configured to move and engage a respective docking arm when the mast is in the raised position; and a plurality of guide arms extending outward from the mast, wherein each guide arm is movably connected to a respective guide rail and movable along the guide rail as the mast is moved between the lowered position and the raised position.

17. The tower of claim 16, wherein each docking arm comprises a trolley in rolling engagement with a respective guide rail, and wherein each guide arm comprises a trolley in rolling engagement with a respective guide rail.

18. The tower of claim 16, further comprising at least one member extending from the outer lattice structure that is configured to be connected to an external structure, wherein the at least one member comprises a breakable element.

19. The tower of claim 16, wherein the outer lattice structure further comprises at least one cross-arm and at least one insulator suspended from the cross-arm that is configured to support one or more electrical power transmission lines.

* * * * *